US006083098A

United States Patent [19]

Sotoda

[11] Patent Number: 6,083,098

[45] Date of Patent: Jul. 4, 2000

[54] COLLECTIVE AIR INTAKE AND EXHAUST CHIMNEY

[75] Inventor: Shoshichi Sotoda, Ashoro-cho, Japan

[73] Assignee: Marusho Manufacturing Co., Ltd., Hokkaido, Japan

[21] Appl. No.: 09/290,730

[22] Filed: Apr. 12, 1999

[30] Foreign Application Priority Data

Apr. 14, 1998 [JP] Japan ..... 10-121738

[51] Int. Cl.[7] ..... F23L 17/04

[52] U.S. Cl. ..... 454/8; 126/312; 126/856

[58] Field of Search ..... 432/72; 454/8; 126/307 R, 312, 85 B

[56] References Cited

FOREIGN PATENT DOCUMENTS 49-45436 4/1974 Japan .
53-71227 6/1978 Japan .
61-74741 5/1986 Japan .
62-156232 10/1987 Japan .

*Primary Examiner*—Henry Bennett
*Assistant Examiner*—Jiping Lu
*Attorney, Agent, or Firm*—Dike, Bronstein, Roberts & Cushman, LLP; David G. Conlin

[57] ABSTRACT

A collective air intake and exhaust chimney suitable for outdoor installation which avoids clogging by snow or frost, which comprises an inner flue (8), a heat insulating layer (12), an outer flue (13), an intake passage (10) between the outer flue and the heat insulating layer, and an exhaust passage inside the inner flue. The device has a double flue branch (3) suitable for connection, e.g., to each floor of a building, which is preferably similar in size and structure to the double flue (8, 12, 13) of the intake and exhaust chimney, and is adapted to be slidably fitted to the intake and exhaust pipe of a forced draft direct vent type heater, and is supported by a supporting member.

1 Claim, 3 Drawing Sheets

COLLECTIVE AIR INTAKE AND EXHAUST CHIMNEY

BACKGROUND OF THE INVENTION

1. Field of the Invention

The present invention relates to a collective air intake and exhaust chimney to be applied to a forced draft direct vent type (a method to intake air from the outdoors and exhaust combustion air to the outdoors) heater and a pot type (a method to intake air from the indoors and exhaust combustion air to the outdoors) heater which are used in a severely cold region, for example, in Hokkaido.

2. Prior Arts

Priorly, in a condominium in a severely cold region, a forced draft direct vent type heater for each of the homes is connected to a collective air intake and exhaust chimney to intake and exhaust air collectively.

And, a collective air intake and exhaust chimney is disposed indoors of the condominium, or a collective air intake and exhaust chimney is disposed outdoors along the outer wall.

However, although the case of the collective air intake and exhaust chimney disposed indoors does not come into question, in the case of the collective air intake and exhaust chimney disposed outdoors, there is a fear that the chimney is clogged by snow or frost, and also problems occurs in an attaching structure and air-tight structure at the connection between the collective air intake and exhaust chimney and forced draft direct vent type heater of each of the homes.

Therefore, the applicant has filed Japanese Patent Application No. 30575 of 1998 to improve the attaching structure and air-tight structure at the connection between the collective air intake and exhaust chimney and the intake and exhaust pipe from the forced draft direct vent type heater of each of the homes.

As shown in FIG. 3, in Japanese Patent Application No. 30575 of 1998, collective air intake and exhaust double flue 1 of a condominium is concentrically comprised of inner flue 8, heat insulating layer 12, and outer flue 13 from the inner side, wherein intake passage 10 between the outer flue 13 and the heat insulating layer 12 and exhaust passage 11 inside the inner flue 8 are formed, double flue branch 3 to be connected to each floor from the collective air intake and exhaust double flue 1 has the same diameter and the same structure as those of the collective air intake and exhaust flue 1, and is concentrically comprised of inner flue branch 8', heat insulating layer branch 12', and outer flue branch 13' from the inner side, wherein intake passage branch 10' between the outer flue branch 13' and the heat insulating layer branch 12' and exhaust passage branch 11' inside the inner flue branch 8' are provided, ring-like disk 15 whose outer circumferential edge is welded to the outer flue branch 13' is provided at the condominium side of the double flue branch 3, a number of intake openings 16 are provided at a part of clogging disk 15 to clog the outside intake passage branch 10' in the circumferential direction, ring-like supporting member 18 for supporting and fixing exhaust pipe 25 of intake and exhaust pipe 20 from a forced draft direct vent type heater of each of the homes is fixed to the inner circumferential edge 17 of the clogging disk 15 by screw 19, ring-like attaching plate 21 whose outer circumferential edge is welded to the outer flue branch 13 is provided at the condominium wall face side of the double flue branch 3, the inner circumferential edge of the attaching plate 21 is structured so as to support intake pipe 26 of the intake and exhaust pipe 20 from the forced draft direct vent type heater of each of the homes, and a space between the clogging disk 15 and the attaching plate 21 forms intake storage chamber 24 for storing intake air from the outdoors.

However, tenants of a condominium may change, so that all tenants do not always possess forced draft direct vent type heaters, and some tenants possess pot type heaters. Therefore, a structure to exhaust air from a pot type heater in addition to a forced draft direct vent type heater for a condominium has been demanded.

SUMMARY OF THE INVENTION

In order to achieve the abovementioned themes, a collective air intake and exhaust chimney of the invention structured so that collective air intake and exhaust double flue 1 of a condominium is concentrically comprised of inner flue 8, heat insulating layer 12, and outer flue 13 from the inner side, wherein intake passage 10 between the outer flue 13 and heat insulating layer 12 and exhaust passage 11 inside the inner flue 8 are formed, double flue branch 3 to be connected to each floor from the collective air intake and exhaust double flue 1 has the same diameter and the same structure as those of the collective air intake and exhaust double flue 1, and is concentrically comprised of inner flue branch 8', heat insulating layer branch 12' and outer flue branch 13' from the inner side, wherein intake passage branch 10' between the outer flue branch 13' and heat insulating layer branch 12' and exhaust passage branch 11' inside the inner flue branch 8' are provided, ring-like clogging disk 15 whose outer circumferential edge is welded to the outer flue branch 13' is provided at the condominium side of the double flue branch 3, a number of intake openings 16 are provided at a part of the clogging disk 15 which clog the outside intake passage branch 10' in the circumferential direction, ring-like supporting member 18 for supporting and fixing exhaust pipe 25 of the intake and exhaust pipe 20 from forced draft direct vent type heater 31 of each of the homes is fixed to the inner circumferential edge 17 of the clogging disk 15 by screw 19, ring-like attaching plate 21 whose outer circumferential edge is welded to the outer flue branch 13' is provided at the condominium wall face side of the double flue branch 3, and the inner circumferential edge of the attaching plate 21 is structured so as to support the intake pipe 26 of the intake and exhaust pipe 20 from the forced draft direct vent type heater 31 of each of the homes, wherein the intake and exhaust pipe 20 of the forced draft direct vent type heater 31 is comprised of a double pipe having inner exhaust pipe 25 and outer intake pipe 26, the exhaust pipe 25 projects inside the double flue branch 3 and a part supported by the supporting member 18 and a part extending inside the wall face 22 from the indoor side to the outdoor side of the exhaust pipe are slidingly fitted 27 to each other, a part covering the intake storage chamber 24 and a part extending inside the wall face 22 from the indoor side to the outdoor side of the intake pipe 26 are screw-fitted 28 to each other, and intake duct 29 for leading intake air to the forced draft direct vent type heater 31 of each of the homes and exhaust duct 30 for exhausting air from the forced draft direct vent type heater 31 of each of the homes are connected to the intake pipe 26 and exhaust pipe 25 of the intake and exhaust pipe 20 at the indoor side, respectively, and furthermore, exhaust flue 16 to be communicated with the exhaust passage 11 of the collective air intake and exhaust double flue 1 is connected to each floor, and exhaust pipe 33 of a pot type heater 32 is connected to the exhaust flue 16.

As described above, in the collective air intake and exhaust chimney of the invention, since the intake and exhaust pipe of the forced draft direct vent type heater can be divided into two parts at the indoor side and outdoor side, when not using the forced draft direct vent type heater, the screw-fitting and slidingly-fitting at the indoor side are released to remove the pipe, and meanwhile, since the exhaust pipe of the pot type heater can be connected to the exhaust flue, selection between the forced draft direct vent type heater and the pot type heater is possible.

Also, intake air can be gradually heated in a intake storage chamber provided at the front end of the double flue branch at the condominium side, and also the amount of intake air to be fed to the heaters can be controlled by the intake holes provided to the intake pipe of the intake and exhaust pipe.

Furthermore, since the intake passage and exhaust passage in the collective air intake and exhaust double flue, double flue branch are separated from each other by the heat insulating layer and heat insulating layer branch, the exhaust air is not rapidly cooled inside the collective air intake and exhaust double flue and double flue branch, therefore, there is no fear that frost occurs.

DETAILED DESCRIPTION OF THE PREFERRED EMBODIMENTS

Figure 1:
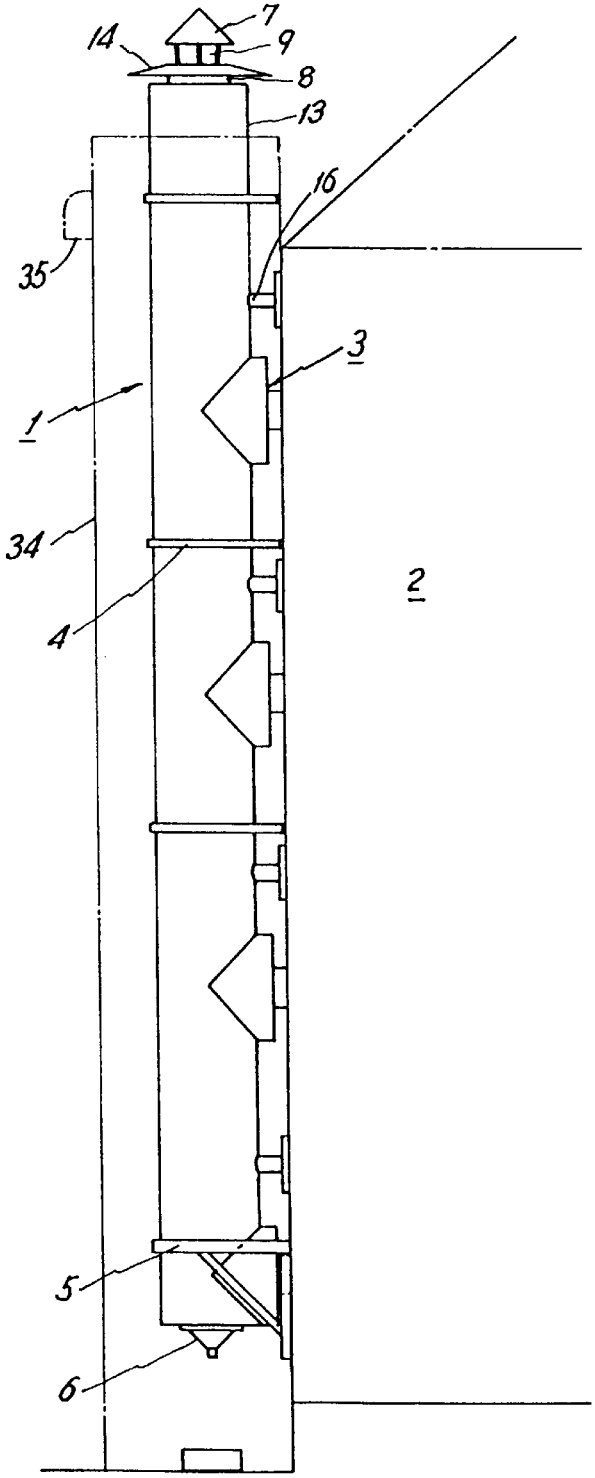
FIG. 1 is a side view showing the condition where the collective air intake and exhaust chimney of the invention is installed.

Intake air from the outdoors is fed to the forced draft direct vent type heater of each of the homes through the intake openings at the front end of the collective air intake and exhaust double flue 1, intake passage 10, intake passage branch 10', intake opening, intake storage chamber 24, intake hole, intake pipe 26, and intake duct 29, and without heat exchange with exhaust air at the parts of the heat insulating layer 12 and the heat insulating layer branch 12', receives heat from exhaust air for the first time in a condition where the intake air is stored in the intake storage chamber 24, and is heated further by means of heat exchange when passing through the intake pipe 26 of the intake and exhaust pipe 20 for feed. On the contrary, exhaust air from the forced draft direct vent type heater of each of the homes is fed to the outdoors through the exhaust duct 30, exhaust pipe 25, exhaust passage branch 11', exhaust passage 11, and exhaust opening 9, is gradually cooled by means of heat exchange when passing through the exhaust pipe 25 of the intake and exhaust pipe 20, and is cooled further at a portion of the intake holes of the intake storage chamber 24, however, during this time, the cooling is not rapid, so that condensation does not occur. Thereafter, although the exhaust air passes through the exhaust passage branch 11' and exhaust passage 11, since heat of intake air is not transmitted by the heat insulating layer branch 12' and heat insulating layer 12 in the exhaust passage branch 11' and the exhaust passage 11, the exhaust air is discharged outdoors as it is via exhaust opening 9 without heat exchange.

On the other hand, for the pot type heater 32, since air is taken from the indoor and exhaust air is directly fed to the exhaust passage 11 through the exhaust flue 16, exhaust air is not rapidly cooled, therefore, condensation does not occur.

Embodiment

An embodiment of the invention shall be described below with reference to the attached drawings.

As shown in FIG. 1, the collective air intake and exhaust double flue 1 is installed in a standing condition along the outer wall of condominium 2 by a proper number of metal fittings 4 supported and fixed to the outer wall and attaching support base 5 provided at the lowest part of the multistory condominium 2, and from the collective air intake and exhaust double flue 1, double flue branch 3 and exhaust flue 16 are extended and connected to each floor of the condominium 2, respectively.

And, collecting box 6 to collect liquefied sulfur oxide and impurities contained in combustion exhaust gas is detachably provided at the lowest end of the collective air intake and exhaust double flue 1.

Figure 2:
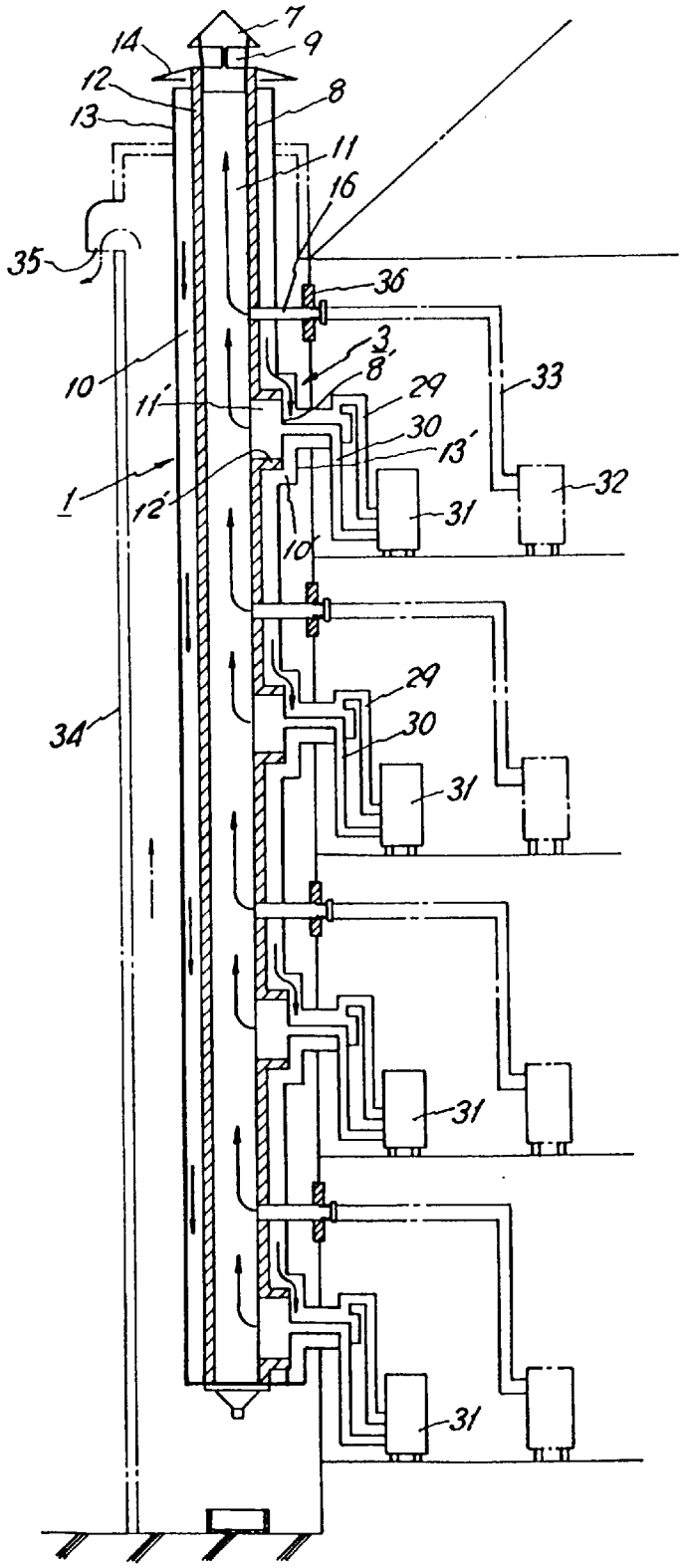
FIG. 2 is a schematic sectional view of the collective air intake and exhaust chimney of the invention.

As shown in FIG. 2, the entire structure of the collective air intake and exhaust double flue 1 is concentrically comprised of inner flue 8, heat insulating layer 12, and outer flue 13 from the inner side, wherein intake passage 10 between the outer flue 13 and heat insulating layer 12 and exhaust passage 11 inside the inner flue 8 are formed, and the heat insulating layer 12 is disposed between intake passage 10 and the exhaust passage 11, whereby heat transmittance between intake air and exhaust air does not occur.

Also, the inner flue 8 and outer flue 13 are formed with a steel pipe or band steel plate wound around, while the heat insulating layer 12 is formed from materials such as rock wool and glass wool, which have heat insulation effects and are convenient to handle.

Furthermore, the front end upper side of the inner flue 8 of the collective air intake and exhaust double flue 1 is covered by chimney cover 7, and also the chimney cover 7 is provided so as to project outward and cover the exhaust opening 9 opened at the upper part of the inner flue 8. The exhaust opening 9 is provided with a punching metal with a hole area percentage of 60%.

In the collective air intake and exhaust double flue 1, with a proper distance to the upper end of the inner flue 8, the heat insulating layer 12 surrounds the outer circumference of the inner flue 8, outer flue 13 forming intake passage 10 is provided outside the heat insulating layer 12, stepped chimney cover 14 fixed to the inner flue 8 is provided so as to cover the front end upper parts of both heat insulating layer 12 and outer flue 13, and the chimney cover 14 projects further so as to cover the intake openings provided in the outer flue 13.

Furthermore, the double flue branch 3 has the same diameter and structure as those of the collective air intake and exhaust double flue 1, and is concentrically comprised of inner flue branch 8', heat insulating layer branch 12', and outer flue branch 13' from the inner side, wherein intake passage branch 10' between the outer flue branch 13' and heat insulating layer branch 12' and exhaust passage branch 11' inside the inner flue branch 8' are provided, and the heat insulating layer branch 12' is disposed between the intake passage branch 10' and the exhaust passage branch 11', whereby heat transmittance does not occur between intake air and exhaust air in the same way as the collective air intake and exhaust double flue 1.

Figure 3:
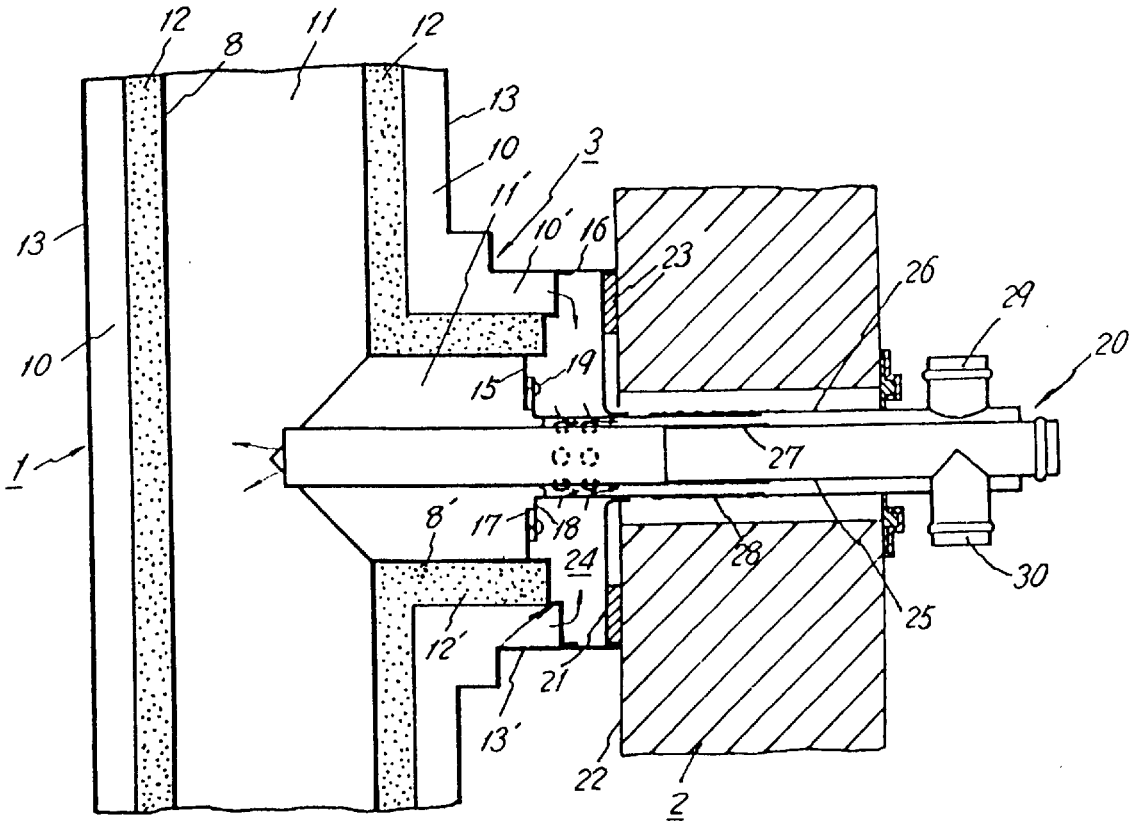
FIG. 3 is a partially enlarged sectional view of the collective air intake and exhaust chimney of the invention.

Also, as shown in FIG. 3, at the condominium 2 side of the double flue branch 3, ring-like clogging disk 15 whose outer circumferential edge is welded to the outer flue branch 13 is provided, which is provided with a number of intake openings at a part to clog the outside intake passage branch 10' in the circumferential direction, and furthermore, the inner circumferential edge 17 is formed so as to clog the end part of the center heat insulating layer branch 12' and cover a part of the inside exhaust passage branch 11', as a whole, whereby the disk is stepped.

And, at the inner circumferential edge 17 of the clogging disk 15, ring-like supporting member 18 for supporting and fixing the exhaust pipe 25 of the intake and exhaust pipe 20 from the forced draft direct vent type heater of each of the homes is fixed by screw 19, and an overlapping portion of the inner circumferential edge 17 and supporting member 18 is provided with a ring-like seal packing (not illustrated) to improve the sealing effect.

Also, at the wall face side of the condominium 2 side of the double flue branch 3, ring-like attaching plate 21 whose outer circumference is welded to the outer flue branch 13' is provided, and at the outer circumferential edge of the attaching plate 21, ring-like wall face seal packing 23 is provided to improve the sealing between the wall face 22 of the condominium 2.

And, the inner circumferential edge of the attaching plate 21 is structured so as to support the intake pipe 26 of the intake and exhaust pipe 20 from the forced draft direct vent type heater 31 of each of the homes, and the space between the clogging disk 15 and the attaching plate 21 forms intake storage chamber 24 for storing intake air from the outdoors.

Also, the intake and exhaust pipe 20 of the forced draft direct vent type heater 31 is comprised of a double flue having the inner exhaust pipe 25 and outer intake pipe 26, the exhaust pipe 25 projects inside the double flue branch 3 and a part supported by the supporting member 18 and a part extending inside the wall face 22 from the indoor side to the outdoor side of the exhaust pipe are slidingly fitted 27 to each other, meanwhile a part covering the intake storage chamber 24 and a part extending inside the wall face 22 from the indoor side to the outdoor side of the intake pipe 26 are screw-fitted 28 to each other.

Furthermore, a part of the intake pipe 26 covering the intake storage chamber 24 is provided with two rows of a number of intake holes for leading intake air from the outdoors to the intake pipe 26 are provided in the circumferential direction.

And, intake duct 29 for leading air to the forced draft direct vent type heater 31 of each of the homes and exhaust duct 30 for air exhaust from the forced draft direct vent type heater 31 of each of the homes are connected to the intake pipe 26 and exhaust pipe 25 of the intake and exhaust pipe 20 at the indoor side, respectively.

Furthermore, the exhaust flue 16 communicated with the exhaust passage 11 of the collective air intake and exhaust double flue 1 is connected to each floor via concrete thimble 36 provided on the outer wall, and the exhaust pipe 33 of pot type heater 32 is connected to the exhaust flue 16.

Also, the periphery of the collective air intake and exhaust double flue 1 is covered with heat insulating enclosure 34 to protect the collective air intake and exhaust double flue 1 from external air, and also, air vent 35 is provided at the upper part of the heat insulating enclosure 34.

Next, to install the double flue branch 3 to each floor of the condominium, in advance, to supporting plate 18 attached to the inner circumferential edge 17 of the clogging disk 15 provided inside the double flue branch 3 at the condominium 2 side, a part to be supported by the supporting plate 18 of the exhaust pipe 25 of the intake and exhaust pipe 20 is fixed, and to the attaching plate 21 provided outside the double flue branch 3 at the condominium side, a part to cover the intake storage chamber 24 of the intake pipe 26 is fixed.

Then, in a condition where the part to be supported by the supporting plate 18 of the exhaust pipe 25 and the part to cover the intake storage chamber 24 of the intake pipe 26 are fixed to the front end of the condominium side of the double flue branch 3, the part to be supported by the supporting plate 18 and the part to cover the intake storage chamber 24 are inserted in the wall hole opened in the wall face 22 of the condominium 2, whereby the air intake and exhaust double flue 1 is installed in a standing condition so that the wall face seal packing 23 of the attaching plate 21 is pressed against the wall face 22.

In this condition, parts of the exhaust pipe 25 and intake pipe 26 reach only the middle of the wall hole opened in the wall face 22.

Next, if the other parts of the exhaust pipe 25 and intake pipe 26 of the intake and exhaust pipe 20 are inserted in the wall hole of the wall face 22 from the indoor side and rotated, by screw-fitting 28, the parts of the intake pipes 26 are coupled with each other, and the parts of the exhaust pipe 25 receive a pressing effect of the intake pipe 26 by means of slidingly-fitting 27 to be coupled with each other, likewise.

Then, at the wall face 22 side of the indoor side, an installing plate conventionally well-known is attached, and intake and exhaust pipe 20 is inserted in a hole of the installing plate, whereby the intake and exhaust pipe 20 can be supported.

Next, when using a pot type heater in each of the homes, the indoor side parts of the exhaust pipe 25 and intake pipe 26 of the intake and exhaust pipe 20 of the forced draft direct vent type heater 31 is reversely rotated from the indoor side, by screw-fitting 28 of the intake pipe 26, the parts of the intake pipe 26 are disconnected from each other, and also, the parts of the exhaust pipe 25 receives a pulling effect of the intake pipe 26 by slidingly-fitting 27 to be disconnected from each other.

And, at the wall face 22 side of the indoor side, the wall hole is attached with a conventionally well-known clogging disk to be clogged, and the exhaust pipe 33 of the pot type heater 32 is connected to the exhaust flue 16, whereby the pot type heater 32 can be installed.

Also, as necessary, both of the forced draft direct vent type heater 31 and the pot type heater 32 can be simultaneously used.

What is claimed is:

1. A collective air intake and exhaust chimney having a structure in which a collective air intake and exhaust double flue for a condominium is concentrically comprised of an inner flue, heat insulating layer, and outer flue from the inner side, in which an intake passage between said outer flue and said heat insulating layer and an exhaust passage inside said inner flue are formed, a double flue branch to be connected to each floor from the collective air intake and exhaust double flue has the same diameter and structure as those of the collective air intake and exhaust double flue and is concentrically comprised of a inner flue branch, heat insulating layer branch, and outer flue branch from the inner side, in which a intake passage branch between said outer flue branch and said heat insulating layer branch and a exhaust passage branch at the inner side of said inner flue branch are provided, a ring-like clogging disk whose outer circumferential edge is welded to said outer flue branch is provided at the condominium side of the double flue branch, the part to clog the outside intake passage branch is provided with a number of intake openings in the circumferential direction, a ring-like supporting member for supporting and fixing an exhaust pipe of an intake and exhaust pipe from a forced draft direct vent type heater of each of the homes is fixed on the inner circumferential edge of said clogging disk, a ring-like attaching plate whose outer circumferential edge is welded to said outer flue branch is provided to the double flue branch at the condominium wall face side of the double flue branch, and the inner circumferential edge of the attaching plate having a structure which supports an intake pipe of an intake and exhaust pipe from a forced draft direct vent type heater of each of the homes, wherein the intake and exhaust pipe of the forced draft direct vent type heater is comprised of a double pipe having an inner exhaust pipe and an outer intake pipe, said exhaust pipe projects inside the double flue branch and a part to be supported by the supporting member and a part extending inside the wall face from the indoor side to the outdoor side of the exhaust pipe are slidingly fitted to each other, and a part to cover an intake storage chamber and a part extending inside the wall face from the indoor side to the outdoor side of the exhaust pipe are screw-fitted to each other, and an intake duct for feeding air to the forced draft direct vent type heater of each of the homes and an exhaust duct for exhaust from the forced draft direct vent type heater of each of the homes are connected to the intake pipe and exhaust pipe of the intake and exhaust pipe at the indoor side, and furthermore, an exhaust flue to be communicated with the exhaust passage of the collective air intake and exhaust double flue is connected to each floor, and an exhaust pipe of a pot type heater is connected to the exhaust flue.

* * * * *